US005793599A

United States Patent [19]

Schmitz

[11] Patent Number: 5,793,599

[45] Date of Patent: Aug. 11, 1998

[54] CONTROL OF THE ATTRACTION OF AN ARMATURE OF A SWITCHING MAGNET AND A SWITCHING ARRANGEMENT FOR PERFORMING THE METHOD

[75] Inventor: Günter Schmitz, Aachen, Germany

[73] Assignee: Fev Motorentechnik GmbH & Co. KG, Aachen, Germany

[21] Appl. No.: 662,624

[22] Filed: Jun. 13, 1996

[30] Foreign Application Priority Data

Jun. 14, 1995 [DE] Germany ..... 195 21 676.8

[51] Int. Cl.[6] ..... H01H 9/00

[52] U.S. Cl. ..... 361/154; 361/190; 361/194

[58] Field of Search ..... 361/154, 170, 361/190, 194, 152

[56] References Cited

U.S. PATENT DOCUMENTS 4,326,234 4/1982 Shuey ..... 361/154

4,893,228 1/1990 Orrick et al. ..... 363/89

FOREIGN PATENT DOCUMENTS 3923477 7/1989 Germany ..... H01F 9/04

*Primary Examiner*—Brian K. Young

*Assistant Examiner*—Stephen Jackson

*Attorney, Agent, or Firm*—Spencer & Frank

[57] ABSTRACT

A method of energy-saving regulation of the attraction of an armature of a switching magnet, particularly an electromagnet for a control element in an internal combustion engine, wherein a medium voltage $U_Z$ is formed by switching to the lowest-available supply voltage $U_V$, the medium voltage being sufficient to regulate a current $I_S$ in order to build up the magnetic field of the electromagnet.

7 Claims, 6 Drawing Sheets

$I_S$
t $U_S$
t $U_Z$
ΔU
$U_Z$
t $I_V$
t $U_T$
$U_2$
$U_1$
t $I_S$
a
t $U_S$
10
11
t $U_Z$
t $I_V$
t $U_T$
t

CONTROL OF THE ATTRACTION OF AN ARMATURE OF A SWITCHING MAGNET AND A SWITCHING ARRANGEMENT FOR PERFORMING THE METHOD

REFERENCE TO RELATED APPLICATIONS

This application is related to commonly assigned copending United States Patent Application No. (Attorney docket MXTNL 0176), filed Jun. 7, 1996, which corresponds to German Patent Application No. 195 21 078.6, filed Jun. 9, 1995, and which is incorporated herein by reference.

This application claims the priority of German Patent Application No. 195 21 676.8, filed Jun. 14, 1995, which is incorporated herein by reference.

BACKGROUND OF THE INVENTION

The present invention relates to a method of energy-saving regulation of the attraction of an armature of a switching magnet, particularly an electromagnet for a control element in an internal combustion engine, and to a switching arrangement for carrying out the method.

Electromagnetic switching magnets in which a control element is operated by the attraction or release of an armature are often required to achieve high switching speeds and, at the same time, large switching forces. For example, to operate gas-exchange or cylinder valves in internal combustion engines, switching arrangements are used, for example as disclosed in the above identified copending U.S. patent application and as shown in FIG. 8, which comprise a magnetic armature 26 which is connected to and controls the relevant valve via a rod 27, which occupies its inoperative or neutral position between two electromagnets 21 and 22 due to spring forces caused by springs 28.1 and 28.2 when the respective electromagnet coils 23.1 and 23.2 are without current, and which is alternatingly attracted to one or the other electromagnet by the alternate energization of the electromagnets, causing the armature 26 to be brought into one or the other switching position. In gas-exchange valves, this corresponds to the open or closed position, respectively, of the valve. To operate the valve, that is, to effect a movement from one switching position into the other, the holding or retaining current at the respective holding coil 23.1 or 23.2 supplied by a d.c. current source 29, preferably linearly regulated, is shut off. Consequently, the holding force of the electromagnet ceases under the spring force, and the armature 26 begins to move, accelerated by the spring force. After the armature has passed through its neutral or inoperative position, its movement is slowed by the spring force of the oppositely-located spring 28.1 or 28.2. Now, in order to capture and hold the armature 26 in the other switching position, the other electromagnet 21 or 22 is supplied with current. This "capturing process" requires relatively high energies that particularly lead to relatively high power draws at high switching frequencies, and thus to an increase in fuel consumption when the process is employed in a motor vehicle.

To reduce energy consumption, German Patent Application DE-A-39 23 477.0 proposes to reduce the excitation current at the "capturing magnet" prior to impact of the armature and to keep the current constant over a specific period of time in order to achieve a reduction in the power to be applied by the electrical system. However, a disadvantage of current stabilization is that a voltage drop occurs at the control transistor, which leads to losses. These losses are particularly high if the coil resistance must be preset to be relatively low and the supply voltage must be preset to be comparatively high. These pre-settings are necessary, however, to assure rapid current increase times, so that it is ensured that the desired constant current level is achieved at the time of impact of the armature on the pole face of the capturing magnet. To avoid the losses dictated by this, DE-A-39 23 477.0 proposes not to keep the current linear in the constant-current phase, but rather to supply it with clock pulses. The clocking must, however, be discontinued at the time of the anticipated impact of the armature so that the time of impact can even be recognized. If the anticipated time of impact has a broad range of fluctuation, the current must correspondingly be regulated in linear fashion, that is, lossy, to a great extent.

SUMMARY OF THE INVENTION

It is an object of the invention to provide a current-regulation method which is energy-saving, on the one hand, but nevertheless permits recognition of impact.

In accordance with the present invention, the above object is accomplished in that a medium or intermediate voltage $U_Z$, which suffices to regulate a current $I_S$ in order to build up the magnetic field of the electromagnet, is formed by switching to the lowest-available supply voltage $U_V$. An advantage of this arrangement is that current consumption can be reduced by switching processes in the range of the supply voltage for the coil of the electromagnet.

In an advantageous embodiment of the invention, it is provided that the medium or intermediate voltage $U_Z$ is only slightly above the value necessary to regulate the current $I_S$, and is formed by clocking between a lower voltage value and an upper voltage value. This regulation has the advantage that the capturing and holding current for the armature is likewise clocked for the entire time during which current is supplied, so that, in comparison to the known current regulation, only a portion of the quantity of current is always required to capture and hold the armature corresponding to the clocking. Nevertheless, a recognition of the impact time is permitted, because the current is regulated in linear fashion through the coil of the electromagnet, at least in the time range of the anticipated impact, and therefore the voltage in the magnet coil is increased by a countervoltage induced by the approach of the armature. Once the armature has impacted, the voltage drops back to its original value, so that a signal can be derived from the change in voltage at the time of impact, and used to actuate the two switching magnets.

The invention further relates to a switching arrangement for energy-saving regulation of a switching magnet which operates a setting member, the arrangement including a linear current regulator which is connected to a cyclically-actuatable voltage regulator which is connected to at least one supply voltage source in order to generate a medium voltage $U_Z$. The current regulator includes means for switching to at least two voltage sources which differ in voltage value, or for predetermining the value of the medium voltage of the voltage regulator.

In a preferred embodiment of the invention, the current regulator provided with means for linear regulation of the current additionally has a regulating transistor, a precision current-measuring resistor and a differential amplifier affected by hysteresis for measuring the voltage drop across the regulating transistor, which actuates a clock switch in the voltage regulator to open when a predetermined differential voltage is exceeded and to close when the differential voltage is not met, as well as a capacitor as an intermediate reservoir or store in the voltage regulator.

The invention is described in conjunction with schematic diagrams and switching arrangements.

DETAILED DESCRIPTION OF THE PREFERRED EMBODIMENT

Figure 1:
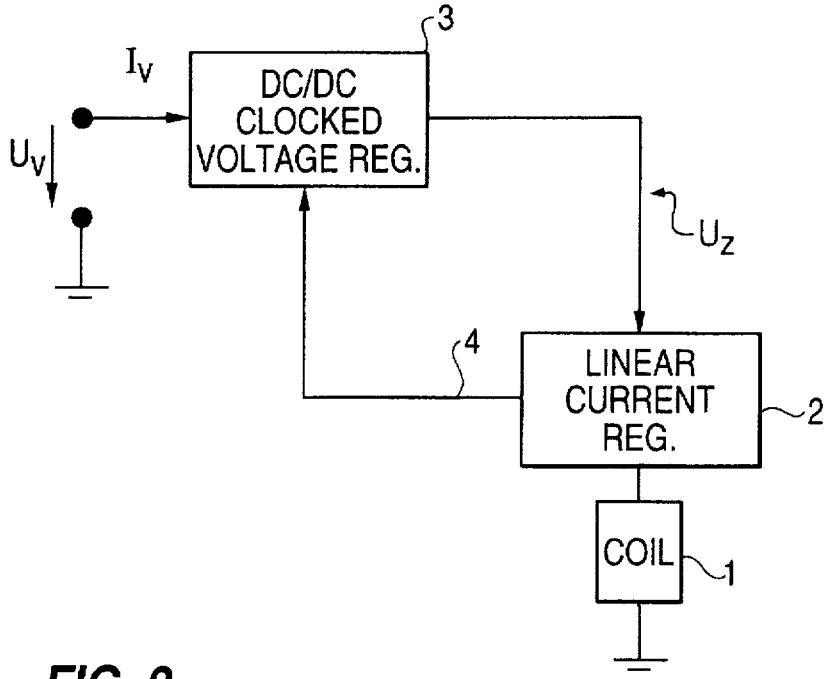
FIG. 1 is a basic block circuit diagram of a regulating circuit according to the invention.
Figure 8:
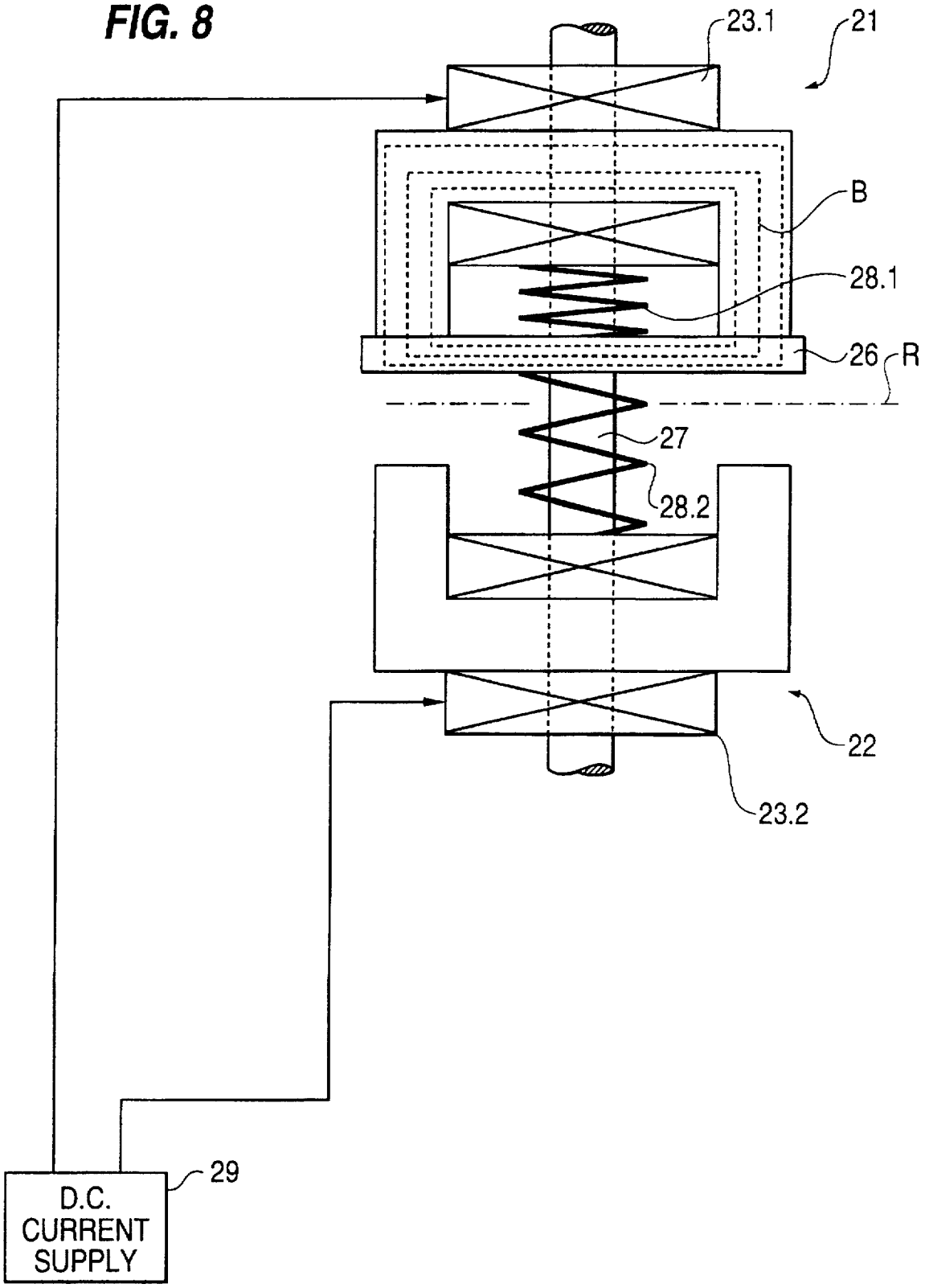
FIG. 8 is a schematic representation of an embodiment of an electromagnetic switching arrangement of the type to which the present invention pertains.

As FIG. 1 shows, an inductive sink 1, for example the coil 23.1 or 23.2 (FIG. 8) of an electrical switching magnet, i.e., an electromagnet, is supplied with a regulated current by a linear current regulator 2. The current regulator 2 receives its supply voltage $U_Z$ from a clocked voltage regulator 3, for example, a DC/DC converter, which employs clocking to convert a constant input voltage $U_V$ into the output voltage $U_Z$, which is regulated so as to have low losses. The current regulator 2 makes its request to the voltage regulator 3 for the supply of input voltage $U_Z$ via an output 4.

Figure 2:
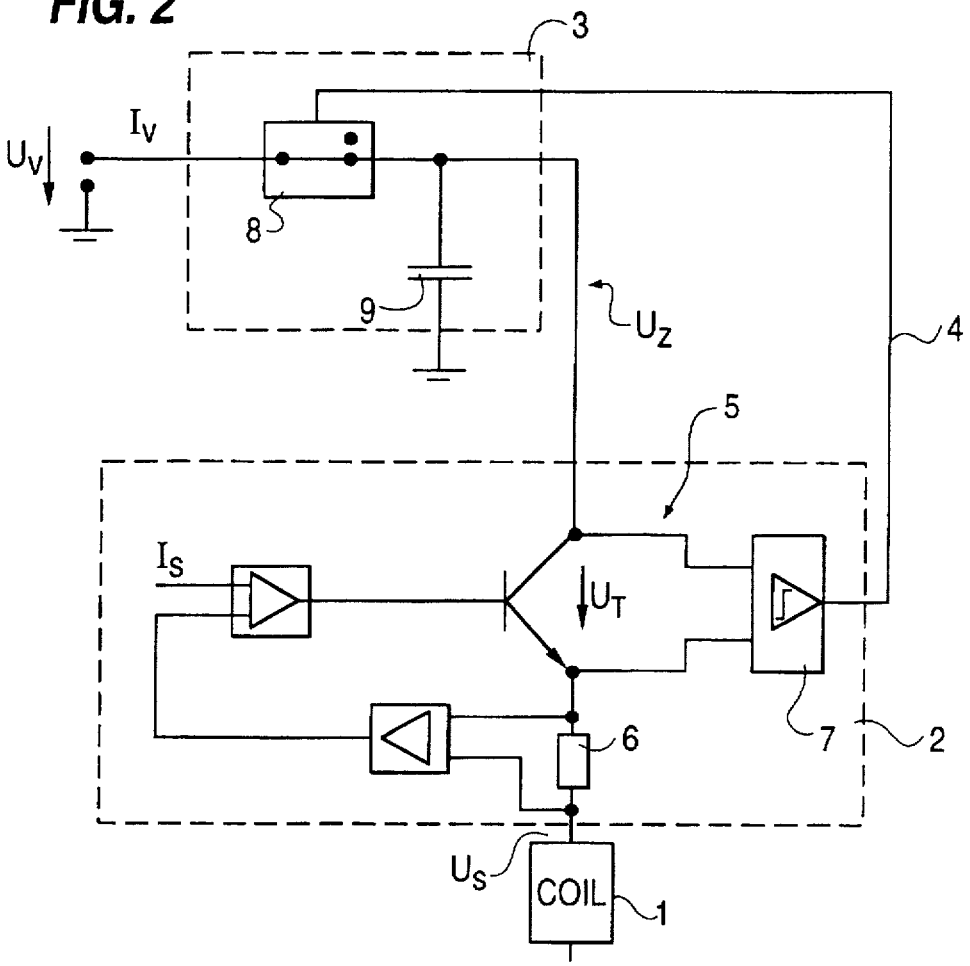
FIG. 2 is a schematic circuit diagram of an embodiment of a switching arrangement according to the basic block circuit diagram of FIG. 1.

FIG. 2 shows a basic outline of an embodiment of this type of switching arrangement. The current regulator 2 includes means, not shown in detail here, of conventional design for linear regulation of the current $I_S$ necessary for supplying the coil 1. The current regulator 2 has a regulating transistor 5, across which a voltage drop $U_T$ occurs. Disposed downstream of the transistor 5 is a precision current-measuring resistor 6, whose value is so small (R about 0) that the resulting voltage drop can be disregarded in a first approximation. The result for the voltage at the transistor is therefore $U_T=U_Z-U_S$. A differential amplifier 7 affected by hysteresis measures the voltage $U_T$ across the emitter-collector path of the transistor 5 and via its output signal on output line 4, ensures that a switch 8 in the voltage regulator 2 is opened when a predetermined differential voltage is exceeded ($U_T>U_M$) and is closed again when a further differential voltage is not met ($U_T>U_L$). Moreover, a capacitor 9, which serves as a current reservoir or store,is provided in the voltage regulator 2 and connected to the output of the switch 8.

Figures 3A, 3B, 3C, 3D, 3E:
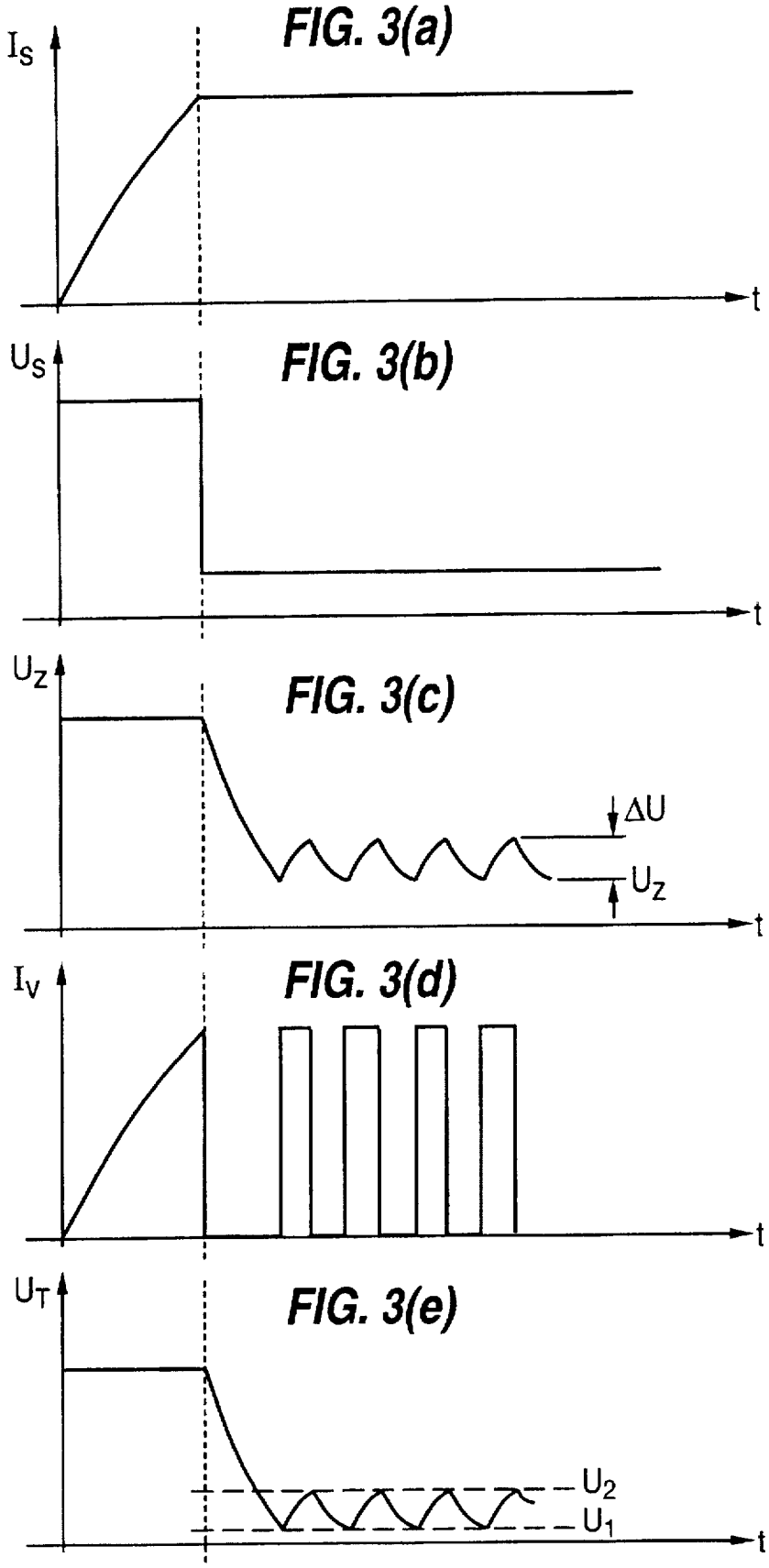
FIG. 3 shows the current and voltage courses for the circuit of FIG. 2 without an approach by an armature to the electromagnet.
Figure 7:
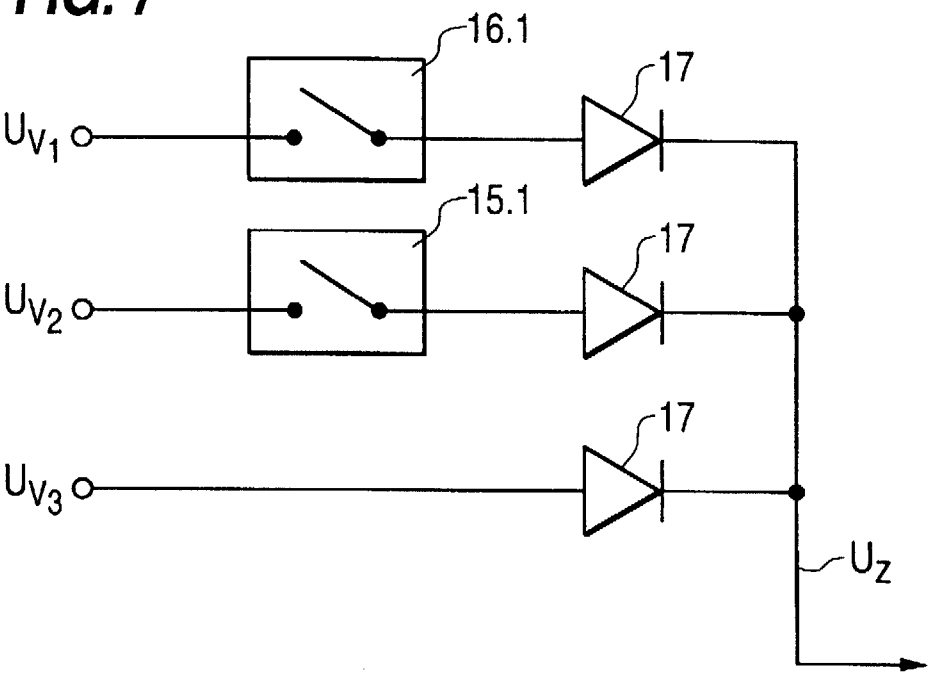
FIG. 7 is a schematic circuit diagram of a modification of the embodiment according to FIG. 6.

FIG. 3 shows the current and voltage courses of the switching arrangement described in conjunction with FIG. 2, without an approach by the armature 26 to a respective electromagnet, e.g., 23.1 or 23.2 of FIG. 7. Curve a) shows the current course I through the coil 1. Curve b) shows the voltage $U_S$ across the coil 1. As can be seen from the two curves, the current $I_S$ first increases in an e-function until it reaches the predetermined nominal value for $I_S$. Until then, the maximum voltage, for example, the voltage $U_Z$, is applied to the coil 1. After the nominal current value $I_S$ has been attained, the linear current regulation is initiated, and stabilizes the current at the value $I_S$. The result of this is a constant coil voltage $U_S$ having the value $I_S \times R_i$, where $R_i$ is the internal resistance of the coil 1.

If the voltage $U_Z$ is now equal to the voltage $U_V$, significant losses occur in the current regulator 2:

$$P_V=I_S \times U_T=I_S(U_V-U_S).$$

If the voltage $U_Z$ drops to a smaller value which is only higher by $\Delta$ U than the coil voltage $U_S$ necessary for stabilization of the current $I_S$, the transistor losses are reduced to $P_V=\Delta U \times I_S$. This intermediate voltage $U_Z$ can now be generated by means of clocking, so that the arrangement operates practically without losses, because either voltage or current becomes zero at a clocked transistor; therefore, the product of the two, that is, the power p, is likewise zero. The course of such a voltage $U_Z$ is illustrated by curve c) in FIG. 3. The current $I_V$ taken from the supply source in this mode of operation is illustrated by curve d). The current $I_V$ first increases exactly as the coil current $I_S$, as shown by curve a), and, as soon as the differential voltage at the transistor 5 reaches a threshold value $U_2$, as shown in FIG. 3, curve e), it becomes zero due to the opening of the switch 8 in the circuit according to FIG. 2. Consequently, the current for the coil 1 is taken from the capacitor 9, which at this point is still functioning only as a current reservoir, and the voltage $U_Z$ drops again. This causes the voltage at the transistor 5 to drop again as well. As soon as the voltage at the transistor 5 has reached a threshold $U_1$ the current from the supply voltage is turned on again by way of the switch 8, the capacitor 9 is recharged, and the voltage $U_Z$ and thus the voltage $U_T$ increase again and the process is repeated. With this measure, the current $I_V$ taken from the source is greatly reduced in comparison to curve a), as curve d) shows, with respect to straightforward linear regulation, and the power draw of the total circuit is likewise reduced.

Figures 4A, 4B, 4C, 4D, 4E:
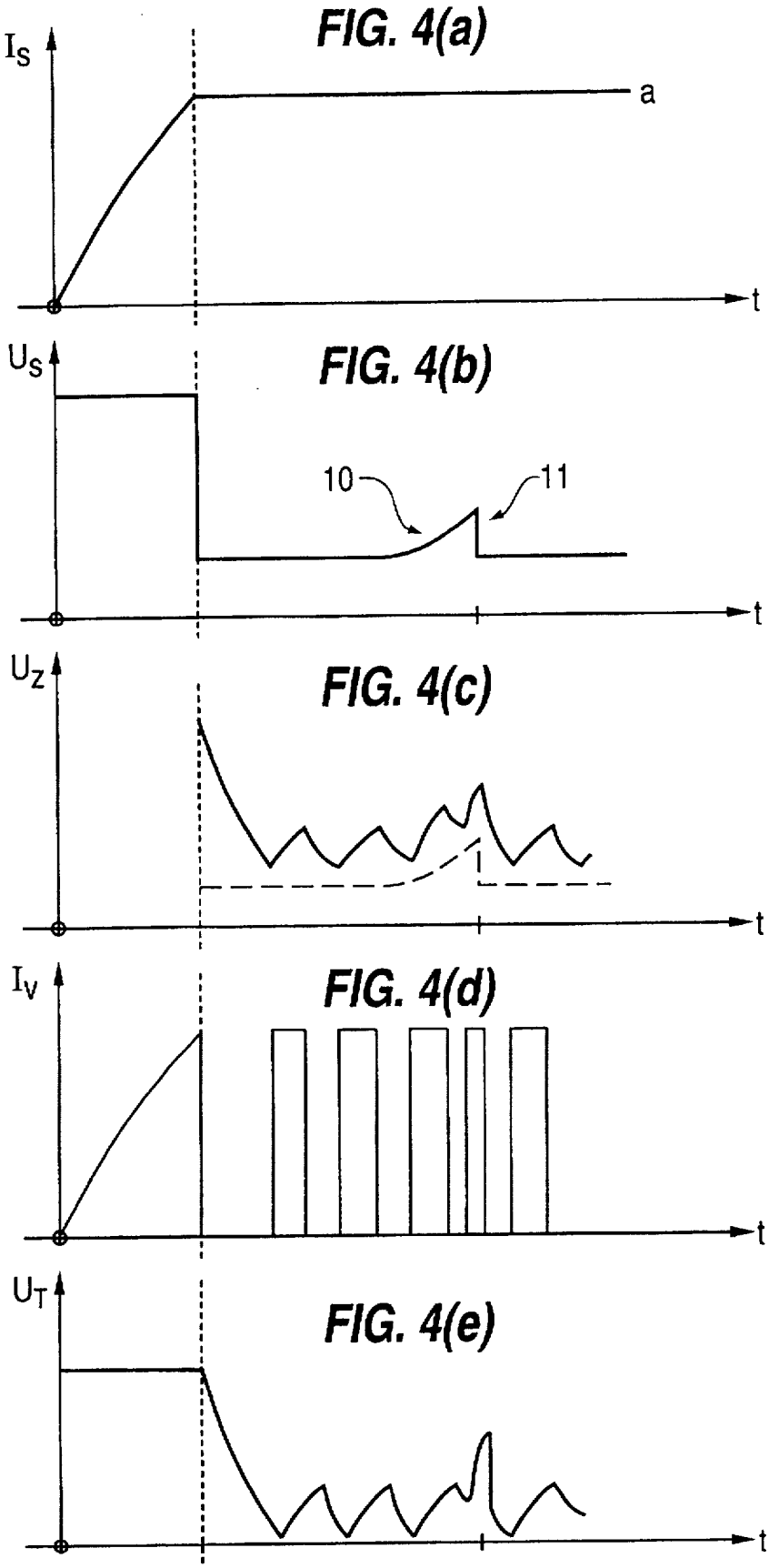
FIG. 4 shows the current and voltage courses for the circuit of FIG. 2 when the armature is approaching the electromagnet.

FIG. 4 shows the current and voltage courses in corresponding curve representations as those of FIG. 3, as courses occur during an approach of the armature 26 toward the electromagnet coil charged with current. The approach of the armature 26 toward the corresponding electromagnet causes the induction of a countervoltage in the electromagnet that permits an increase in the voltage $U_1$ (as indicated by reference numeral 10 in curve b) of FIG. 4) at the coil 1 with a stabilized current as indicated in curve a) of FIG. 4. Once the armature has impacted, the voltage drops again to its original value $U_1$ as indicated by reference numeral 11 in curve b) of FIG. 4. As can readily be seen, the change in voltage can by used to recognize impact as in the past.

For the sake of clarification, curves c), d) and e) of FIG. 4 show the courses of $U_Z$, $I_V$ and $U_T$ during the approach of the armature.

Figure 5:
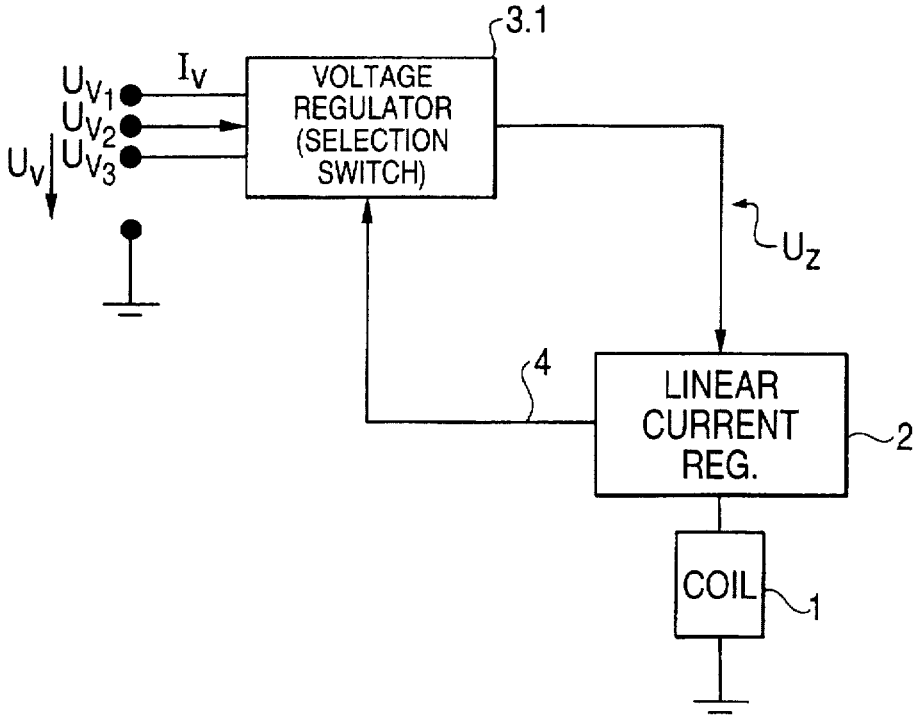
FIG. 5 is a basic block circuit diagram of a switching arrangement for switching to different voltage sources according to the invention.

Instead of the switching arrangements described in FIGS. 1 and 2, it is also possible to save current by switching the medium or intermediate voltage $U_z$ to different supply voltages $U_V$. The underlying principle of this type of circuit is illustrated in FIG. 5. It corresponds to the underlying principle according to FIG. 1, with the exception that a voltage regulator 3.1 is provided in this case, at which three voltage sources $U_{V1}$, $U_{V2}$ and $U_{V3}$ having different voltage values are present for the supply voltage.

The switching is effected such that the minimum voltage supply $U_{V1}$, $U_{V2}$ or $U_{V3}$ required for maintaining the predetermined current $I_S$ is assured at the coil 1. This means that the selected voltage supply $U_{Vn}$ must fulfill the condition $U_{Vn} \geqq U_S + U_{Tmin}$, where $U_{Tmin}$ is the voltage that must drop across the transistor 5, or generally at the regulating unit 2 so that the regulating unit operates reliably. The regulator or regulating unit 2 indicates the corresponding voltage requirement to the voltage switching arrangement 3 via the line 4. In the simplest case, the coil voltage $U_S$ is indicated via the line 4.

Figure 6:
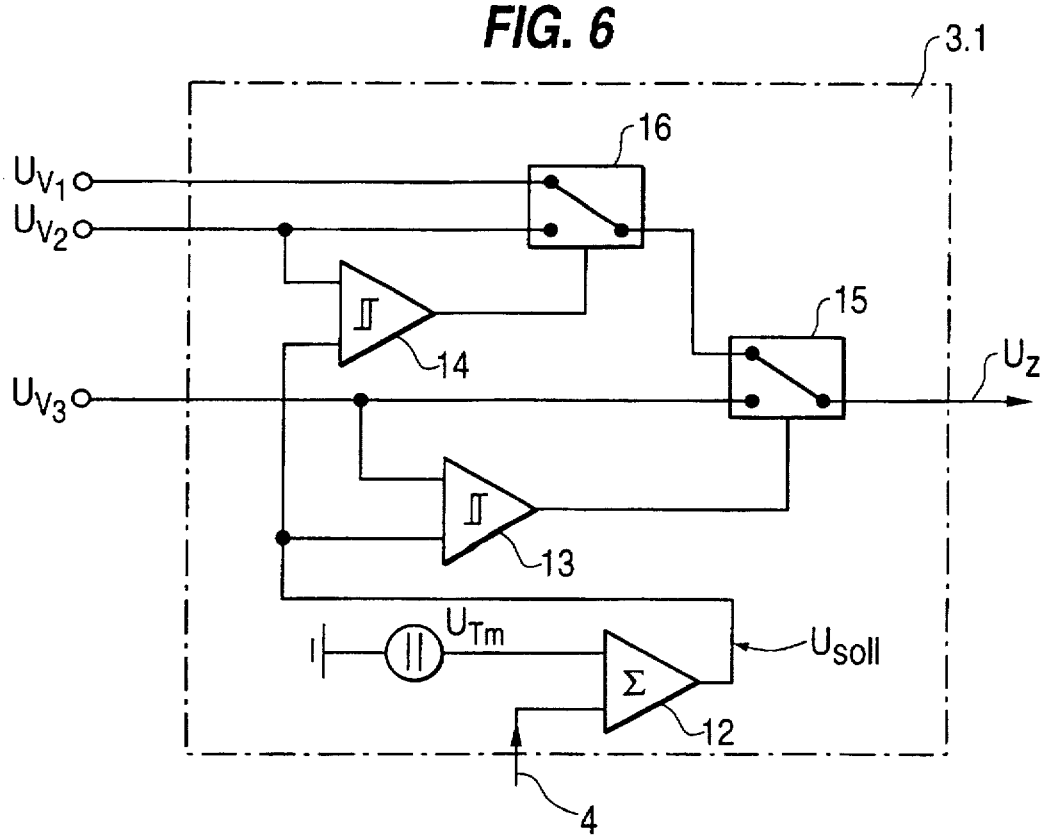
FIG. 6 is a schematic circuit diagram for an embodiment of a circuit of the voltage regulator for the switching arrangement according to FIG. 5.

FIG. 6 shows a basic circuit diagram for a possible embodiment of the voltage regulator 3.1 configured as a voltage selection switch. The supply in this instance is $U_{V1} > U_{V2} > U_{V3}$. In a summating circuit 12, a fixed voltage $U_{Tmin}$ is added to the input signal 4, which can correspond to the voltage $U_S$ at the coil, for example, and is supplied to the comparators 13 and 14, which can be affected by hysteresis, for comparison with the supply voltage $U_{V3}$ or $U_{V2}$, respectively. The voltage resulting from the summation and appearing at the output of circuit 12 is characterized as $U_{soll}$. The lowest supply voltage $U_{V3}$ is directly connected to one input, the lower input as shown, of a switch 15 whose output provides the supply voltage $U_Z$ to the regulator 2. If the voltage $U_{soll}$ is greater than the voltage $U_{V3}$, the output of the comparator 13 is at a high level, and therefore switches the switch 15 from its lower position, wherein its input is connected to $U_{V3}$, into its illustrated upper position wherein its input is connected to the output of a switch 16. The upper stage, which comprises the comparator 14 and the switch 16, operates in an identical manner. That is, if the voltage $U_{soll}$, is greater than the voltage $U_{V2}$, the switch 16 switches from its lower position, wherein its input is connected to $U_{V2}$, into its upper position wherein its input is connected to $U_{V1}$. The output $U_Z$ is thereby supplied with the highest possible voltage $U_{V1}$. If the voltage requirement decreases, and the voltage $U_{soll}$ therefore drops to, for example, $U_{soll} < U_{V2}$, the switch 16 will connect the output $U_Z$ to the source $U_{V2}$. If the voltage $U_{soll}$ drops further to be lower than $U_{V2}$, a switch back to the source $U_{V3}$ occurs. This type of circuit can, of course, also be designed for a larger or smaller number of voltage sources. It can be practical, therefore, with a supply from a cascaded DC/DC converter, to lead out and use the voltage of each individual cascade. Additionally, in use in a motor vehicle, the actual electrical system voltage can be used as a source.

The above-described circuits are only intended to illustrate the principle of the invention and, of course, other circuits can also be used. For example, as shown in FIG. 7, the reversing cascade that ensues in FIG. 6 can be replaced by simple circuit closers 15.1 and 16.1, in which instance respectively downstream diodes 17 are provided to ensure that only the respectively highest voltage becomes effective.

The invention now being fully described, it will be apparent to one of ordinary skill in the art that any changes and modifications can be made thereto without departing from the spirit or scope of the invention as set forth herein.

What is claimed:

1. A method of regulation of the attraction of an armature of an electromagnet for operation of a control element, said method comprising providing at least one supply voltage, regulating the at least one supply voltage to provide a regulated supply voltage as an intermediate voltage value, and utilizing the regulated supply voltage in a current regulator to supply a regulated supply current of a desired value to the coil of the electromagnet; and wherein the step of regulating the at least one supply voltage to provide a regulated supply voltage includes regulating the at least one supply voltage, under control of a feedback signal from the current regulator, to the lowest supply voltage value sufficient to regulate the current to a desired value in order to build up the magnetic field of the electromagnet, whereby energy-saving regulation of the current is achieved.

2. A method as defined in claim 1, wherein the intermediate voltage value is only slightly above the value necessary for regulating the current, and said step of regulating includes clocking the at least one supply voltage value between a lower value and an upper value to form the regulated intermediate supply voltage value.

3. A method as defined in claim 1, further comprising supplying a plurality of supply voltage values; and wherein said step of regulating includes switching to the lowest available supply voltage value sufficient to regulate the current to the desired value in order to build up the magnetic field of the electromagnet.

4. A method as defined in claim 1, wherein: the current regulator has a regulating transistor for the current; and, the feedback signal for controlling the voltage regulator is dependent on a voltage drop across the regulating transistor.

5. A switching arrangement for performing the method described in claim 1 for energy-saving regulation of a switching magnet that operates a control element, said arrangement comprising: a linear current regulator means for supplying the linearly regulated current to the coil of the electromagnet; a cyclically-actuatable voltage regulator connected to at least one supply voltage source for generating said intermediate regulated voltage from the connected at least one supply voltage; and wherein said current regulator includes means for causing said voltage regulator to switch between at least two voltage values to form said intermediate regulated voltage.

6. A switching arrangement as defined in claim 4, wherein said voltage regulator includes a clock switch for connecting a supply voltage to its output as said intermediate regulated voltage when in a closed position and for disconnecting said output from said supply voltage when in an open position, and a capacitor connected to said output of said voltage regulator as a current reservoir; and wherein said current regulator, in addition to being provided with means for linear regulation of the current supplied to the coil of the electromagnet, further includes: a regulating transistor; a precision current-measuring resistor connected in series with said regulating transistor; and a differential amplifier, which is affected by hysteresis, connected for measuring the voltage drop across said regulating transistor and for actuating said clock switch in said voltage regulator to be in said open position when a predetermined differential voltage is exceeded and to be in said closed position when the differential voltage is not met.

7. A switching arrangement as defined in claim 5, wherein: at least two voltage supply sources having different supply voltage values are provided; said voltage regulator includes at least one actuatable reversing switch for selectively connecting one of said voltage supply sources to the output of said voltage regulator; and said current regulator, in addition to being provided with means for linear regulation of the current supplied to the coil of the electromagnet, further includes a regulating transistor, a precision current-measuring resistor connected in series with said regulating transistor, and a differential amplifier, which is affected by hysteresis, connected for measuring the voltage drop across said regulating transistor and for actuating said reversing switch when a predetermined minimum voltage $U_{Tmin}$ is either exceeded or not met to connect the lowest available supply voltage source to the current regulator, where $U_{Tmin}$ is the minimum voltage drop across said regulating transistor for reliable operation.

* * * * *